US011708836B2

(12) United States Patent
Haegele et al.

(10) Patent No.: US 11,708,836 B2
(45) Date of Patent: Jul. 25, 2023

(54) FAN WHEEL

(71) Applicant: IE ASSETS GMBH & CO. KG, Schorndorf (DE)

(72) Inventors: Karl Haegele, Schorndorf (DE); Markus Lechler, Schorndorf (DE)

(73) Assignee: IE ASSETS GMBH & CO. KG, Schorndorf (DE)

( * ) Notice: Subject to any disclaimer, the term of this patent is extended or adjusted under 35 U.S.C. 154(b) by 0 days.

(21) Appl. No.: 17/549,051

(22) Filed: Dec. 13, 2021

(65) Prior Publication Data

US 2022/0099098 A1 Mar. 31, 2022

Related U.S. Application Data

(63) Continuation-in-part of application No. PCT/EP2020/025503, filed on Nov. 11, 2020.

(30) Foreign Application Priority Data

Dec. 18, 2019 (DE) ..... 10 2019 134 887.0

(51) Int. Cl.
*F04D 25/02* (2006.01)
*F04D 19/00* (2006.01)
(Continued)

(52) U.S. Cl.
CPC ..... *F04D 25/028* (2013.01); *F04D 19/002* (2013.01); *F04D 29/329* (2013.01); *F04D 29/36* (2013.01)

(58) Field of Classification Search
CPC .... F04D 25/028; F04D 19/002; F04D 29/329; F04D 29/36; F04D 19/005; F04D 29/364; F05D 2260/40311; F05D 2260/74
See application file for complete search history.

(56) References Cited

U.S. PATENT DOCUMENTS 3,647,320 A * 3/1972 Chilman ..... F01D 7/00 416/157 R
3,672,788 A * 6/1972 Ellinger ..... F01D 7/00 416/152

(Continued)

FOREIGN PATENT DOCUMENTS

DE 39 10784 A1 10/1990
DE 10 2018 106 454 A1 9/2019
JP S6123203 A 10/1986

OTHER PUBLICATIONS

The International Search Report for the corresponding international application No. PCT/EP2020/025503 in the German language dated Feb. 9, 2021, 3 pages.

(Continued)

*Primary Examiner* — Aaron R Eastman
(74) *Attorney, Agent, or Firm* — Ronald S. Lombard

(57) ABSTRACT

A fan wheel with a hub is centrally supported with respect to a drive and coaxially rotatable with the hub between stops relative to the hub. The fan wheel having fan blades extending radially from the hub are rotatable about their axes in a range delimited by the stops. Overlaying the rotational support between the stops of the hub, a rotational support between the hub and the drive is provided including a planetary drive in operative arrangement with an adjustment control ring of the driven hub. The fan blades are rotatable in the hub about their blade axes, and adjustment of the blade angles of the fan blades via drive connections to the adjustment control ring, which connections operate in a manner superimposed on one another starting from the drive of the fan wheel.

4 Claims, 4 Drawing Sheets

(51) Int. Cl.
*F04D 29/32* (2006.01)
*F04D 29/36* (2006.01)

(56) References Cited

U.S. PATENT DOCUMENTS

| | | | | | |
|---|---|---|---|---|---|
| 3,902,822 | A * | 9/1975 | Andrews | F02C 7/36 | 416/170 R |
| 5,152,668 | A * | 10/1992 | Bulman | F01D 7/00 | 416/129 |
| 5,174,716 | A * | 12/1992 | Hora | F01D 7/00 | 416/129 |
| 5,282,719 | A * | 2/1994 | McCarty | B64C 11/44 | 416/165 |
| 2013/0039766 | A1* | 2/2013 | Murikipudi | F04D 29/364 | 416/149 |
| 2016/0244175 | A1* | 8/2016 | Derrez | B64C 11/06 | |
| 2021/0003141 | A1* | 1/2021 | Haegele | F04D 29/329 | |
| 2021/0164355 | A1* | 6/2021 | Haegele | F04D 29/366 | |
| 2022/0268215 | A1* | 8/2022 | Niepceron | F02C 7/36 | |
| 2022/0349410 | A1* | 11/2022 | Robuck | F04D 27/007 | |

OTHER PUBLICATIONS

The English translation of the International Search Report for the corresponding international application No. PCT/EP2020/025503 dated Feb. 9, 2021, 3 pages.
The Written Opinion of the International Searching Authority for the corresponding international application No. PCT/EP2020/025503 in the German language, 7 pages.
The English translation of the International Search Report for the corresponding international application No. PCT/EP2020/025503 dated Feb. 17, 2021, 7 pages.

* cited by examiner

A 1
2
5
4
3
6
A

FAN WHEEL

CROSS-REFERENCE TO RELATED APPLICATIONS

This is a continuation-in-part application of pending international patent application PCT/EP2020/025503 filed Nov. 11, 2020 and claiming the priority of German Patent Application No. 10 2019 134 887.0 filed Dec. 18, 2019. The aforesaid pending international application PCT/EP2020/025503 and German Patent Application No. 10 2019 134 887.0 are both incorporated herein by reference as though fully set forth.

BACKGROUND OF THE INVENTION

Fan wheels with fan blades which extend radially from a fan wheel hub are known in the art. They are used mainly for cooling and for cleaning heat exchanger surfaces by generating an air flow over the heat exchanger surfaces.

There are fan wheel configurations wherein the air flow can be reversed by a reversal of the running direction of the fan wheel, but also configurations wherein the radial fan blades are rotatably supported in the fan wheel hub so that the radial fan blades can be pivoted to positions in which they generate an air flow in an opposite direction. If the reversal of the air flow is provided for by a reversal of the running direction of the fan wheel this can be provided for by a reversal of the drive direction of the drive arrangement, for example of the direction of rotation of an electric drive motor or by the interposition of a reversing gear drive between the drive motor and the fan wheel.

Furthermore, a fan wheel with radial fan blades which are rotatably supported in the fan hub provides for a possibility of controlling the size and the flow direction of the air flow by changing the fan blade angle so that, independently of a change of the power input and/or the speed of the respective drive motor, the strength and/or the direction of the generated air flow can be controlled up to a reversal of the flow direction. For example, the air flow over a heat exchanger surface can be changed from a blowing flow to a suction flow.

These possibilities however are limited—in particular with respect to fan wheels with radial fan blades which are rotatably supported in the fan wheel hub—in that the adjustability of the fan blade angles up to opposite flow directions requires certain distances between the fan blades to permit an uninhibited rotation of the fan blades between their opposite end positions. It is also to be taken into consideration that the adjustment of the fan blades about the fan blade axes is provided for by a drive arrangement in the form of an angular drive of the foot pins of the fan blades via drive pinions which are in engagement with a gear ring which, dependent on the number of fan blades, has a correspondingly large diameter.

This results in a large transmission ratio between the small diameter pinions and the large diameter gear ring and, as a result, requires a large drive force for the gear ring for the adjustment of the fan blade angles within the short periods available for the adjustment of the fan blade angles.

The German patent application DE 10 2018 106 454 A1 discloses the design of a fan wheel which can be driven in opposite directions with a co-axial hub which is rotatable relative to its central drive and adjustable between stops over a certain range. At its circumference the hub is provided with radial fan blades which are supported in the hub so as to be rotatable between stops by a gear arrangement for adjusting the angular positions of the fan blades. The gear arrangement includes pinions which are mounted on the fan blades concentrically with the axes of rotation of the fan blades and which are in engagement with a drive gear structure which is concentric with the hub drive so as to form an angled drive. This, however results in a large transmission ratio of the drive gear structure to the respective fan blade pinions that is a transmission toward fast within a stop-delimited rotational range of the drive gear structure relative to the hub. This results in correspondingly large adjustment and acceleration forces, in particular in the transition plane of the fan blades which plane extends normal to the axis of rotation of the fan wheel between the opposite air flow directions.

The resulting high adjustment and acceleration forces cause relatively high component loads which requires a high-strength structure in particular for the transmission support elements in order to permit the adjustment times to be as short as possible for the transition of the fan blades between opposite air transport directions.

It is the object of the present invention to provide for the reversal of the fan blades of a fan wheel from one to the opposite flow direction position for more advantageous operating conditions, so that short reversal times can be achieved and the stresses on the components of the transmission support structure are reduced.

SUMMARY OF THE INVENTION

In accordance with the invention there is, superimposed and consequently parallel to the angularly limited rotatability of the hub relative to the drive between the rotational stops, an angularly unlimited rotatability between the hub and the drive. In this way, rotational movements of the drive and the hub in opposite directions with angularly limiting stops of the drive relative to the hub and with angularly unlimited constant angular support of the hub relative to the drive can be realized. This is achieved in particular via a planetary drive providing a mean transmission ratio in the connection of the drive to the hub carrying the fan blades and to the fan blades which are rotatable about the fan blade axes. With such an arrangement the respective drive elements in the connection of the fan blades and the drive and of the drive and the hub can be designed to be manufactured at relatively low expenses.

In accordance with the invention, in a particular embodiment, it is expedient for a driven fan wheel with central support via a central hub, to provide for the fan blades which extend radially from the hub and are rotatably supported thereby, for an angular adjustment of the fan blades via an adjustment ring, which is concentric with the central axis of rotation of the fan wheel and extends along the foot ends of the fan blades. This adjustment ring is connected to the fan blades via superimposed drive structures, a first one for controlling the fan blade angular positions independently of the fan wheel drive within an angular range relative to the hub delimited by stops, and a second one within the stop-delimited adjustment range of the fan drive structure for permitting an unlimited rotation.

In connection with the invention it is also expedient to provide the drive support and the drive connection with the unlimited angle of rotation in particular in the form of a planetary drive integrated into the hub and provide the hub in turn with a central support opening for the accommodation of a support pin for the fan wheel. Such a support pin extends suitably in the form of an axial extension of the drive unit for driving the fan wheel whereby good conditions are established for a supportive connection of a drive unit and its connection to the fan wheel.

BRIEF DESCRIPTION OF THE DRAWINGS

The invention and particular features thereof will be described below in greater detail with reference to the accompanying drawings.

It is shown in.

DETAILED DESCRIPTION OF THE INVENTION

Figure 1:
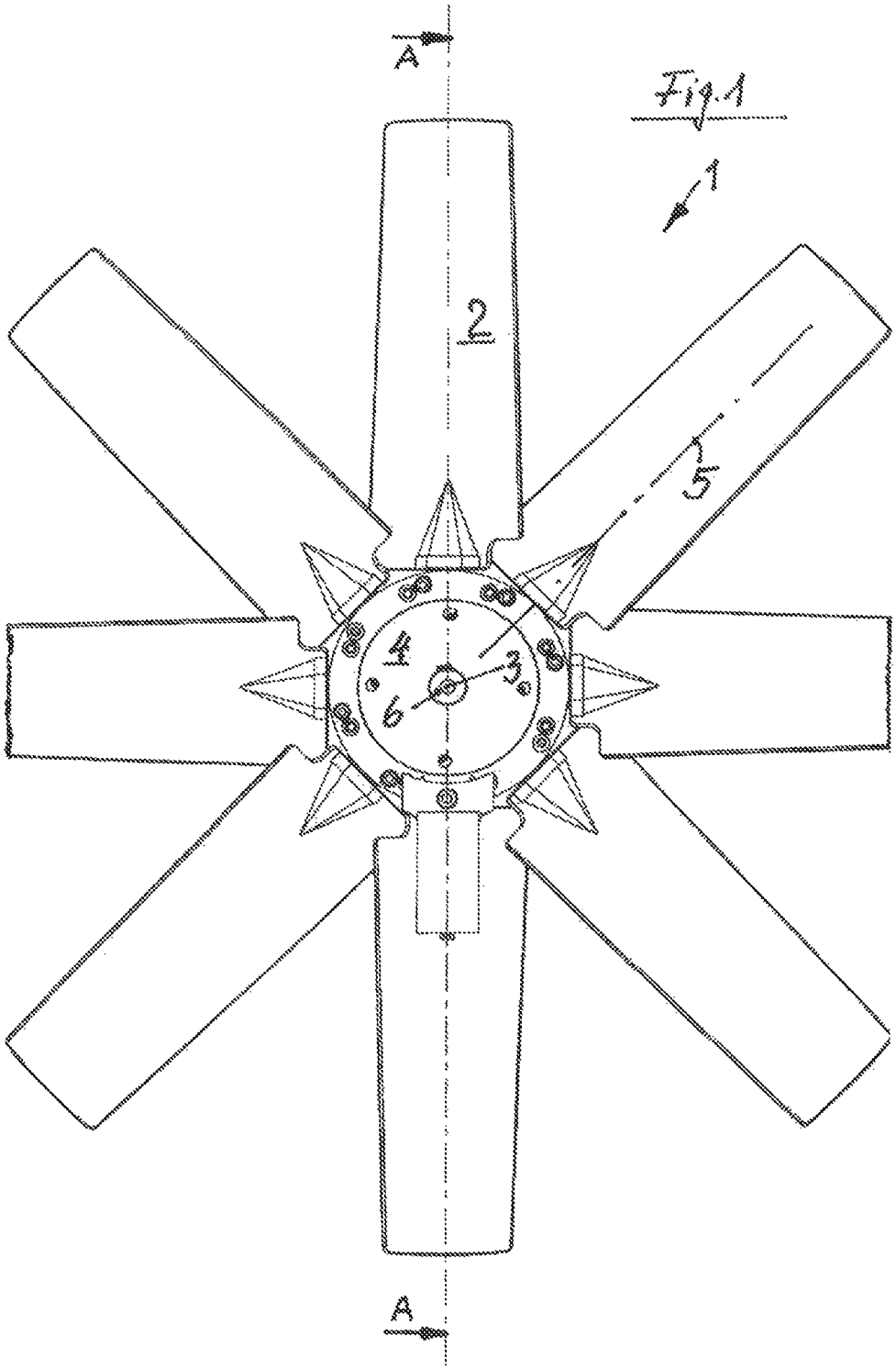
FIG. 1 a front view of a fan wheel which is centrally supported by, and connected to, a drive, the fan wheel includes fan blades radially extending from a hub in which they are supported so as to be rotatable about the blade axes.
Figure 2:
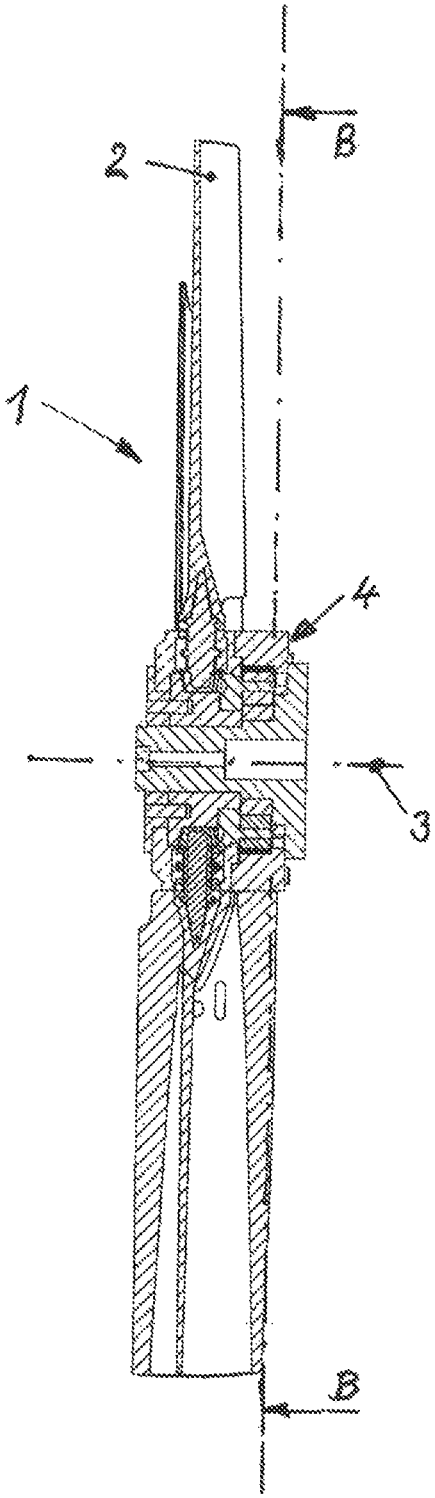
FIG. 2 an axial cross-sectional view of the fan wheel taken along line A-A of FIG. 1.
Figure 3:
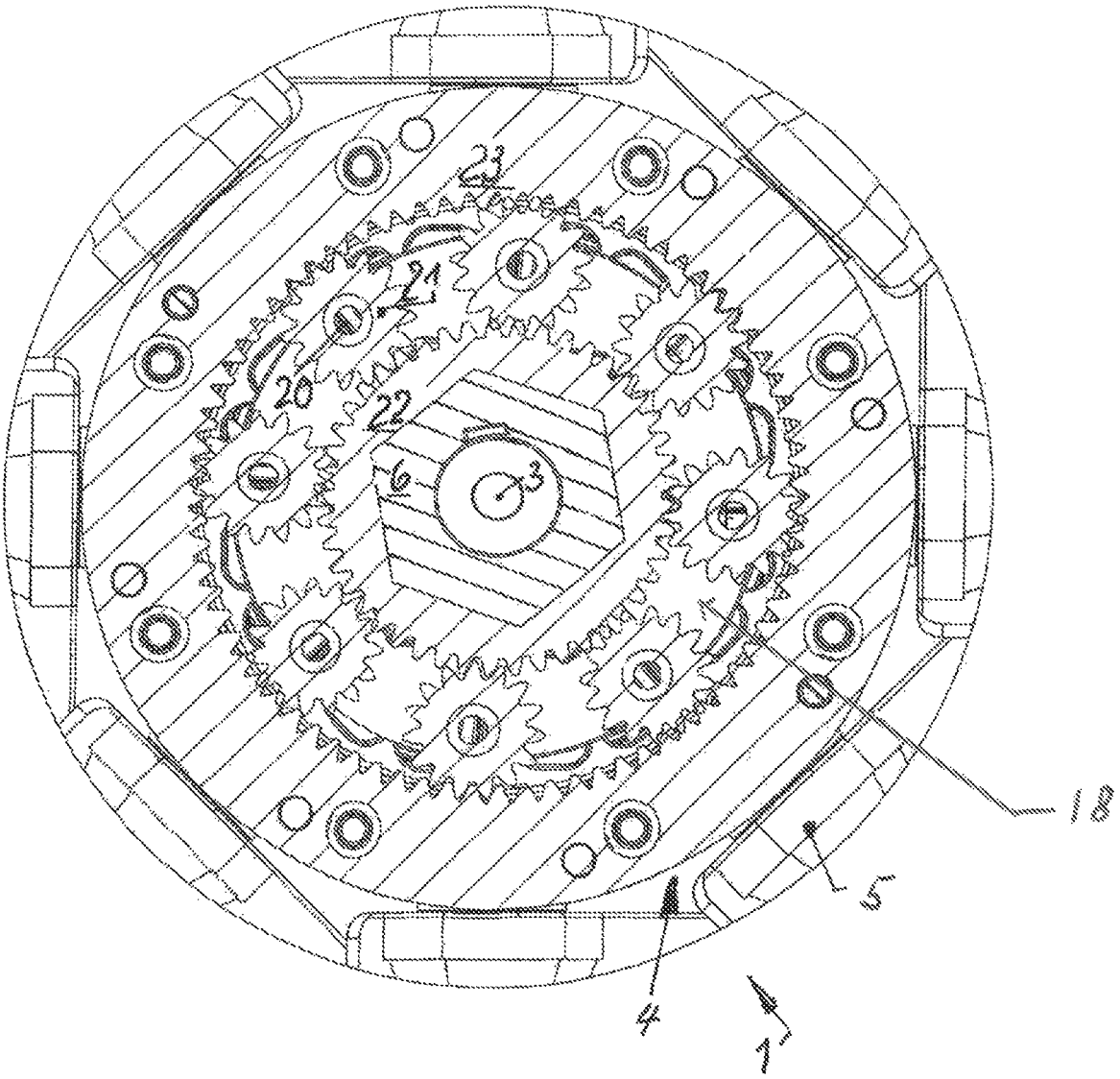
FIG. 3 a cross-sectional view taken along line B-B of FIG. 2 showing the hub area of the fan wheel; and, FIG. 4 an enlarged cross-sectional view taken along line A-A of FIG. 1 showing the hub area with the drive connections for driving the hub and the fan blades which are relatively supported in the hub for the adjustment of the fan blade angles.
Figure 4:
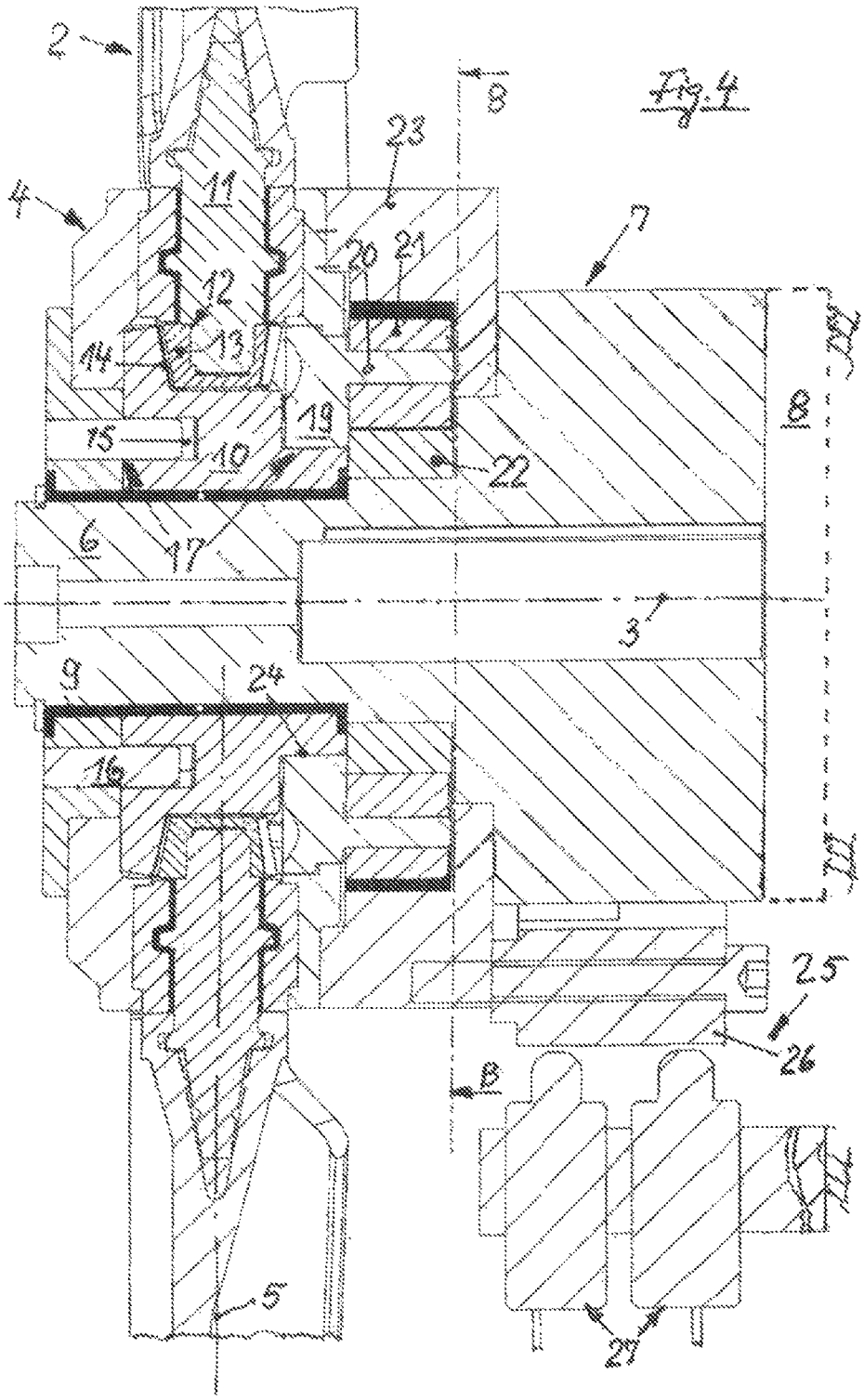

With reference to FIGS. 1-4, the fan wheel is designated by the numeral 1. It has radial fan blades 2 which are supported in the central hub 4 which is rotatable about the axis of rotation 3 of the fan wheel 1. The fan wheel 1 is supported rotatably by a guide pin 6 centrally located with respect to the axis of rotation 3. As shown in FIG. 4, the guide pin 6 forms part of a flange connection 7 of the fan wheel 1 to a drive unit 8, in particular a drive unit such as drive shaft.

As shown in particular in the enlarged representation of FIG. 4 the hub 4 accommodates a central adjustment ring 10 which is rotatably supported on the guide pin 6 via a bearing ring 9. The fan blades 2 are in radial engagement with the central adjustment ring 10 at their foot ends 11 via a transmission structure 12 formed at the fan blade foot ends 11 by conical pinions 13 which are in engagement with an annular gear ring 14 on a side of the central adjustment ring 10. This arrangement forms an angular drive for the fan blades 2 about the fan blade axes 5 comprising a plate gear engagement with pinions.

The drive connection of the fan wheel 1 extending via the hub 4 to the drive unit 8 is formed with regard to the rotation of the fan wheel 1 about its axis of rotation 3 and the angular position of the hub-supported fan blades 2 about the blade axes 5 with respect to the particular angular position of the fan wheel 1, forms two drive paths. The first of these drive paths is provided for the rotational operation of the fan wheel 1 driven by the drive unit 8 for a predetermined angle about its axis of rotation 3 within limits and the second superimposed drive path operates with regard to an angular position of the fan wheel 1 within the stop limits of the fan wheel 1 relative to the drive unit 8 which determines the respective angular position of the fan blade 2 about the fan blade axes 5. In this way, the angular position of the fan blades 2 is set by a super-imposition of the second drive path with the first drive path.

This is achieved by a structure wherein the angular position of the radially outer areas of the hub 4 which accommodate the foot ends 11 of the fan blades 2 are delimited with respect to the central adjustment control ring 10, that is the adjustment range of the foot ends 11 is delimited by stops in that the central adjustment control ring 10 has annular guide tracks 15, into which, for limiting the adjustment range of the foot ends 11 to the length of the guide tracks, stop bolts 16 extend which are position-fixed.

Parallel to such, or a different type of, first drive path there is a second drive path 17 which, within the free operating range of the first drive path, forms a rotational support of the central adjustment control ring 10 relative to the drive unit 8. This rotational support is in the form of a drive connection extending via the adjustment range of the central adjustment control ring 10 to the drive unit 8 with unlimited adjustment movability. The planetary gear carrier 19 which, in accordance with the invention, is connected for rotation with the drive unit 8 for example by a non-round structure 24, such as a hexagonal member, and is provided with bearing pins 20 for supporting the planet gears 21. The planet gears 21 are in engagement with a sun gear 22 which is connected to the flange connection 7 and, consequently, to the drive unit 8 for rotation therewith, again via a non-round structure. The hollow geared wheel 23 which extends around the planet carrier 19 and is in operative arrangement with the planet gears 21 is supported on the hub 4 for rotation therewith. In this way, the control ring 10 is rotatable relative to the drive unit 8 via the hollow geared wheel 23 of the planetary drive 18 within the stop-delimited rotatability of the hub 4 relative to the central adjustment control-ring 10 for an adjustment of the fan blade angles. By locking the planetary drive 18, the rotational position of the fan blades 2 about the blade axes 5 is fixed within the respective movement range area of the control ring 10. A fixing of the planetary drive 18 facilitates in accordance with the invention also a control of the fan wheel for a particular desired air flow volume.

In connection with the above described exemplary embodiment of the invention, supplementarily, it may be expedient to provide additionally a control arrangement 25 which senses the rotational position of the hub 4 of the fan wheel 1 for an adjustment and possibly fixing of the angular position of the fan blades. This can be provided by a wheel, for example a ribbed wheel 26 or similar which is connected to the hub 4 for rotation therewith and via which the corresponding angular position of the fan blades 2 can be determined by means of an optical or mechanical sensor arrangement, for example by means of a whip, not shown in the drawings, which is fixed to the drive unit 8, and whose position is converted to control signals for the air volume flow.

Furthermore, such a sensor arrangement may also be used as an active control arrangement for example in the form of a control whip, not shown in the drawings, for the adjustment of the fan wheel to a desired volume flow of the fan wheel. With the said sensor and/or control arrangement 27, the, in each case, set points corresponding to the required air flow volume can be called for, that is, the fan wheel blades can be adjusted to the respective positions. This may also be used, if desired, for a remote actuation.

A fan wheel is provided herewith which, via a drive arrangement with a control ring of a drive hub and a control ring drive connection, a planetary gear carrier, is connected for rotation with a drive unit, and the fan blades which are supported in the hub so as to be rotatable about their blade axes, permits an adjustment of the fan blade angles via drive connections which, starting from the drive of the fan wheel operate in a superposed manner with regard to the control ring. For an adjustment of the fan wheel blades the fan wheel may be provided with a fan blade rotational position control and/or sensing arrangement connected to the hub for rotation therewith.

What is claimed is:

1. A fan wheel (1) comprising:

a central hub (4) which is centrally supported with respect to a drive shaft (8) and coaxially rotatable therewith, fan blades (2) extending radially from the central hub (4) over its circumference and supported in the central hub (4) via conical pinions (13) so as to be rotatable about their axes (5) over a limited range relative to the hub (4) for an adjustment of the angular radial position of the fan blades (2), the central hub (4) accommodating a central adjustment control ring (10) rotatably supported on a guide pin (6) centrally located with respect to an axis of rotation (3) of the fan wheel (1), the central hub (4) and the central adjustment control ring (10) rotatably supported on the guide pin (6) via bearing ring (9), the fan blades (2) in operative engagement with the central adjustment control ring (10) at foot ends (11) of the fan blades (2), the central adjustment control ring (10) rotatably disposed on the central hub (4) in engagement with the conical pinions (13) and operatively connected to the drive shaft (8) via a planetary gear arrangement (18), the guide pin (6) including a flange connection (7) operatively connected to the drive shaft (8) and, the planetary gear arrangement (18) including a planetary gear carrier (19) attached to the central adjustment control ring (10), the planetary gear carrier (19) having a hollow wheel arrangement consisting of a single hollow geared wheel (23) with a gear structure for operatively engaging non-compound planet gears (21) supported on the central hub (4) for rotation therewith, the planet gears (21) surrounding and operatively engaging a sun gear (22) which is arranged adjacent the central hub (4) of the fan wheel (1) at the side thereof, the planetary gear carrier (19) in operational rotational connection with the drive shaft (8) by a non-round structure (24), the central adjustment control ring (10) rotatable relative to the drive shaft (8) via the hollow geared wheel (23) within the stop-delimited rotatability of the central hub (4) relative to central adjustment control ring (10).

2. The fan wheel according to claim 1, wherein an angularly limited rotational drive connection is formed by stop-delimited annular guide tracks (15) within the central adjustment control ring (10) and a stop bolt (16) fixed to the drive shaft (8) and extending into the respective stop-delimited annular guide track (15).

3. The fan wheel according to claim 1, wherein the fan blades (2) are engaged with the central adjustment control ring (10) via a miter wheel gearing with pinions (13) provided at the foot ends (11) of the fan blades (2) and engaged by a gear ring (14) provided on the central adjustment control ring (10).

4. The fan wheel according to claim 1, wherein the positions of the fan blades (2) relative to the drive shaft (8) are adjustable via a control and/or sensor arrangement (27) operating in a control and/or sensing mode.

* * * * *